US012543873B2

(12) United States Patent
Bryan

(10) Patent No.: US 12,543,873 B2
(45) Date of Patent: Feb. 10, 2026

(54) INFANT FITTED BED SHEET WITH ATTACHED BLANKET

(71) Applicant: Trinetta Janine Bryan, Old Forge, PA (US)

(72) Inventor: Trinetta Janine Bryan, Old Forge, PA (US)

( * ) Notice: Subject to any disclaimer, the term of this patent is extended or adjusted under 35 U.S.C. 154(b) by 192 days.

(21) Appl. No.: 18/244,289

(22) Filed: Sep. 10, 2023

(65) Prior Publication Data

US 2024/0423393 A1 Dec. 26, 2024

Related U.S. Application Data

(60) Provisional application No. 63/509,313, filed on Jun. 21, 2023.

(51) Int. Cl.
*A47G 9/02* (2006.01)
*A47D 15/00* (2006.01)

(52) U.S. Cl.
CPC ..... *A47G 9/0246* (2013.01); *A47D 15/008* (2013.01); *A47G 9/0223* (2013.01)

(58) Field of Classification Search
CPC ... A47G 9/0246; A47G 9/0261; A47D 15/008
See application file for complete search history.

(56) References Cited

U.S. PATENT DOCUMENTS 1,885,558 A * 11/1932 Starz ..... A47D 15/008 2/69.5
2,062,611 A * 12/1936 Rosenthal ..... A47D 15/008 5/494
2,627,617 A * 2/1953 Avila ..... A47G 9/0238 5/494
2,677,834 A 5/1954 Moynihan
3,083,378 A * 4/1963 Pursell ..... A47C 21/022 5/413 R
3,845,513 A * 11/1974 Hubner ..... A47G 9/083 2/69.5
4,202,052 A 5/1980 Bilanzich
4,241,466 A * 12/1980 Mendyk ..... A47G 9/02 5/500
5,027,456 A * 7/1991 Wadsworth ..... A61F 5/3776 5/494
5,084,929 A * 2/1992 Staudinger ..... A47D 15/008 5/494

(Continued)

FOREIGN PATENT DOCUMENTS

GB 2510925 A * 8/2014 ..... A47C 31/105

OTHER PUBLICATIONS

"ergoPouch HowTo use Baby Tuck Sheet", May 24, 2022, https://www.youtube.com/watch?v=V7HsLb3AEBE (Year: 2022).*

*Primary Examiner* — Eric J Kurilla
(74) *Attorney, Agent, or Firm* — Peter Borsari

(57) ABSTRACT

The infant fitted bed sheet with attached blanket relates to safe sleep for infants and aims at solving how to keep an infant warm while in their sleep environment of a bassinet or crib. The fitted sheet with attached blanket has been developed primarily for use by infants at the age of 0-5 months and is a fitted bed sheet that has an attached blanket that is securely sewn on. The fitted bed sheet may feature an elastic band around the edges of the sheet that allows the sheet to firmly stay in place when placed on to the bassinet or crib mattress.

11 Claims, 6 Drawing Sheets

(56) References Cited

U.S. PATENT DOCUMENTS

| | | | | | |
|---|---|---|---|---|---|
| 5,732,424 | A * | 3/1998 | Bond | A47G 9/02 | 5/498 |
| 5,794,285 | A * | 8/1998 | Burch | A47G 9/02 | 5/500 |
| 6,009,874 | A * | 1/2000 | Sartin | A47D 5/00 | 5/655 |
| 6,301,729 | B1 * | 10/2001 | Hall | A47D 15/008 | 5/482 |
| 6,341,396 | B1 * | 1/2002 | Carapezza | A47G 9/023 | 5/482 |
| 6,490,741 | B1 * | 12/2002 | Wheeler | A47G 9/02 | 5/494 |
| 7,810,184 | B2 * | 10/2010 | McCollum | A47G 9/0238 | 5/500 |
| 8,020,226 | B2 | 9/2011 | Landry | | |
| 10,758,067 | B2 | 9/2020 | Gaudyn | | |
| 11,426,014 | B1 * | 8/2022 | Bagley, Sr. | A47G 9/08 | |
| 11,659,870 | B2 | 5/2023 | Damir | | |
| 2006/0200907 | A1 * | 9/2006 | Cha | A47G 9/0207 | 5/482 |
| 2010/0275932 | A1 * | 11/2010 | Shackleton | A47D 5/00 | 128/872 |
| 2017/0055591 | A1 * | 3/2017 | Clouse | A41B 13/06 | |
| 2017/0325601 | A1 | 11/2017 | Von Yurt | | |
| 2020/0060448 | A1 * | 2/2020 | Boesch | A47C 31/105 | |
| 2022/0110462 | A1 * | 4/2022 | Sack | A47G 9/0223 | |

* cited by examiner

INFANT FITTED BED SHEET WITH ATTACHED BLANKET

CROSS-REFERENCE TO RELATED APPLICATIONS

This application relates back to provisional application U.S. 63/509,313 filed on Jun. 21, 2023 and incorporates it in its entirety.

FIELD OF INVENTION

The present invention relates to safe sleep for infants and aims at solving how to keep an infant warm while in their sleep environment of a bassinet or crib. More particularly, the present invention relates to articles used during sleep; fitted bed sheets and blankets.

The present invention has been developed primarily for use by infants at the age of 0-5 months. It is appreciated that the invention is not limited to that particular age range or bed type.

BACKGROUND OF THE INVENTION

An infant's sleeping environment at birth is a bassinet or crib. Based on the American Academy of Pediatrics, (AAP), guidelines, it is recommended that an infant sleep on their back on a flat, firm sleep surface such as a bassinet or crib for the first year of the child's life.

In addition, AAP advises keeping this environment free of blankets or any loose objects to prevent accidental harm to the infant. As a result, Parents and Guardians are left to figure out how to keep their child safe and warm while in their sleeping environment.

One commonly used option is a wearable blanket. This is a traditional method of wrapping, (commonly known as "swaddling"), the infant in a blanket. However, with the use of this method, the infant's limbs are restricted by inhibiting movement.

In addition, often times with the use of this method, the blanket unravels and becomes loose causing a potential hazard or sudden infant death syndrome, (SIDS), related issues. In addition, it is advised to discontinue use at the age of two months once the infant has the mobility to roll over. Because of the aforementioned risks, this option is not recommended by AAP.

Another commonly used option is an apparatus known as a Sleep Sack; a weighted bodysuit made of blanket-like material that the infant is placed in. With the use of this bodysuit however, the infant is bound into material that is stuffy and uncomfortable. This option is also not recommended by AAP.

U.S. Pat. No. 10,758,067 filed on Nov. 1, 2017, by Halina Gaudyn attempts to solve the issue with a sleeping bag invention, however, the invention does not fully address the problem.

In Gaudyn's Patent, the invention discloses a mattress and a sleep aid, on a first end of a partially fitted sheet. The fitted sheet is tucked into and secured onto a side of the mattress and on a second end of the mattress the sleep aid being a blanket.

The blanket is attached to the fitted sheet being large enough to be folded over an infant, the fitted sheet having hook and loop fasteners and the blanket having a matable hook and loop fasteners situated on the blanket opposite the fitted sheet, such that when the blanket is folded over, and the hook and loop fasteners are mated a pocket capable of containing an infant is formed.

As there are similar components to Gaugyn's invention, her invention discloses a detachable fitted sheet and blanket from the mattress that is attached by hook and loop fasteners. The concern with this design approach is that with force from the infant, it could cause the blanket to detach and become loose creating a hazard within the infant's sleep environment.

Presentably, there is no safe approach to keeping an infant warm in their bassinet or crib.

SUMMARY OF THE INVENTION

The present invention addressed to solve the current problem as it discloses a fitted bed sheet that has an attached blanket that is securely sewn on. The fitted bed sheet may feature an elastic band around the edges of the sheet that allows the sheet to firmly stay in place when placed on to the bassinet or crib mattress.

The blanket features 2 components; a left flap and right pocket. The left flap is used to securely wrap around the infant and keep them in place.

The left flap may feature hook and loop fasteners used to adjust the snugness around the infant. The right pocket is where the infant is placed into. The blanket material may be made up of elastane that allows the blanket to be pulled to adjust to the size of the infant.

The advantage of the present invention is that the blanket is attached to the fitted sheet allowing warmth to the infant and keeping their sleep environment free of loose objects.

DETAILED DESCRIPTION OF THE INVENTION

The dimensions for the infant fitted sheet may come in vary sizes.

Figure 1:
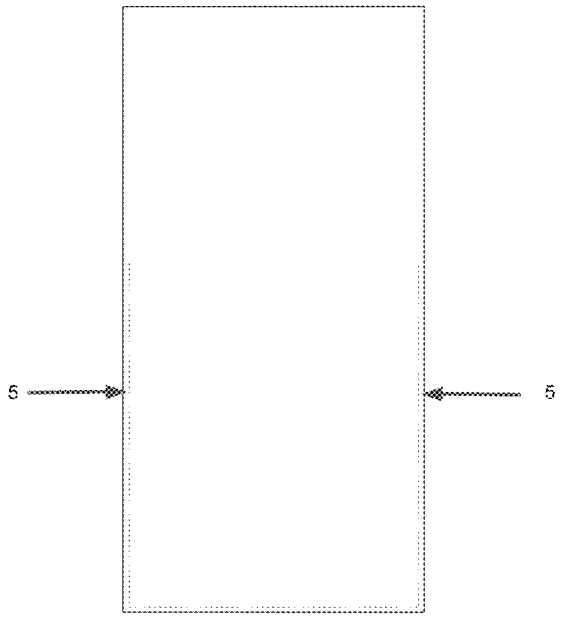
FIG. 1 depicts a bottom view of the infant fitted sheet with attached blanket.

FIG. 1 depicts a bottom view of the infant fitted sheet with attached blanket wherein the left, right and bottom sides of the blanket are sewn to the edge of the fitted sheet (5).

Figure 2:
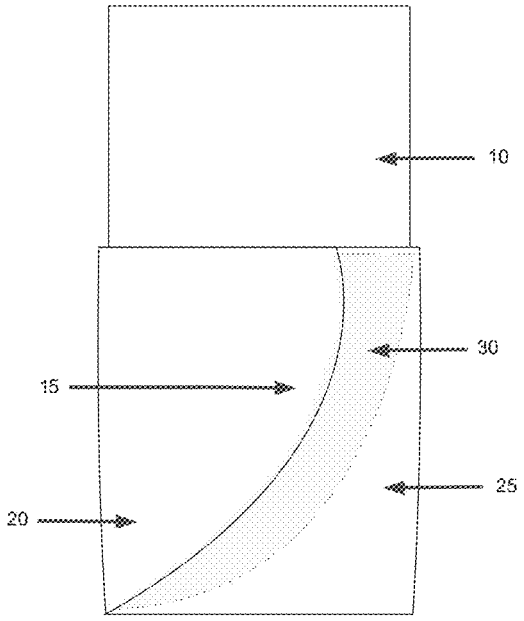
FIG. 2 depicts a top view of the infant fitted sheet with attached blanket which depicts the left flap and right pocket.

FIG. 2 depicts a top view of the infant fitted sheet with attached blanket which depicts the left flap (20) and right pocket (25) wherein the fitted sheet portion (10) is a thin fabric material. The rough hook fastener area is sewn under the left flap (15) and wraps over and on to the right pocket to tighten the blanket over the infant. The fastener adheres to the right pocket's soft loop fastener area on top (30).

The left flap (20) and right pocket (25) are made of a thick fabric that may contain elastane material. The soft loop fastener area (30) is wider than the rough hook fastener (15) under the left flap and allows parents to adjust the tightness based on the size of the infant.

Figure 3:
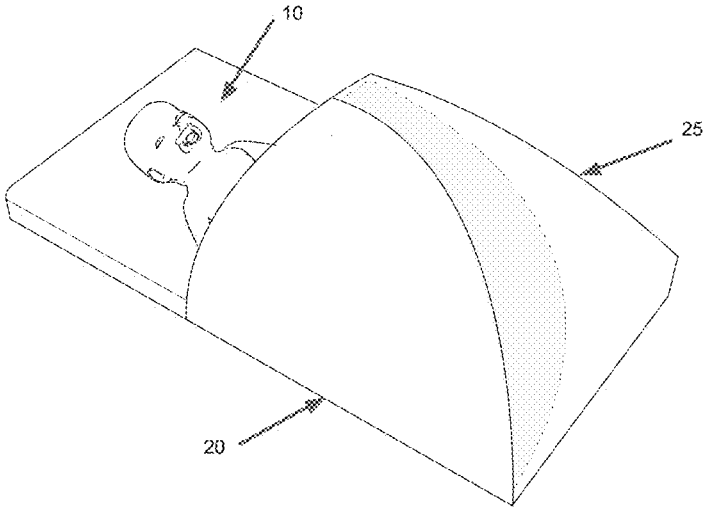
FIG. 3 depicts a perspective view of the infant fitted sheet with attached blanket which depicts the left flap and right pocket.

FIG. 3 depicts a perspective view of the infant fitted sheet with attached blanket which depicts the left flap and right pocket, wherein the right pocket is sewn to the fitted sheet on the bottom edge and the left flap is sewn to the fitted sheet on the bottom edge.

Figure 4:
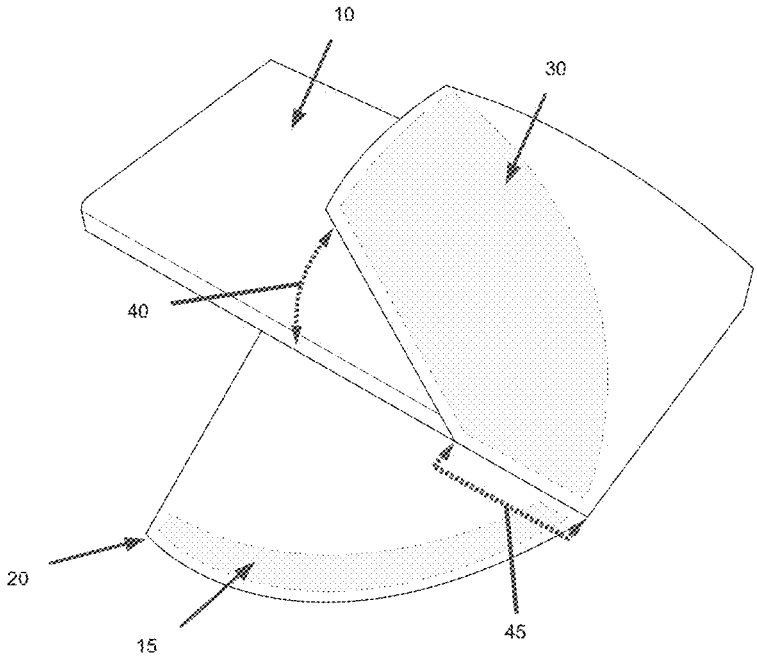
FIG. 4 depicts a perspective view of the infant fitted sheet with attached blanket which depicts the left flap open.

FIG. 4 depicts a perspective view of the infant fitted sheet with attached blanket which depicts the left flap open wherein the top left corner of the right pocket can be folded over to allow the parent to place the infant in the pocket cavity (40). The soft loop fastener area is sewn on top of the right pocket (30) and the right pocket should be sewn on the bottom left side (45). The rough hook fastener area (15) is sewn under the left flap.

Figure 5:
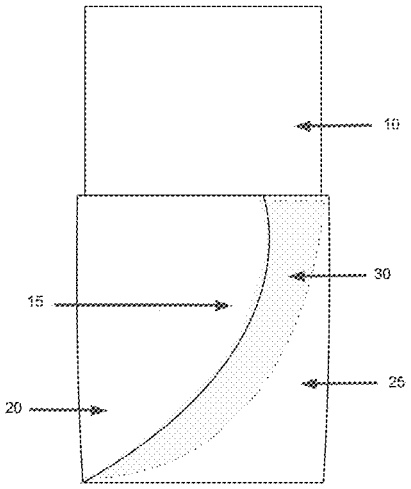
FIG. 5 depicts a top view of the infant fitted sheet with attached blanket which depicts the left flap and right pocket.

FIG. 5 depicts a top view of the infant fitted sheet with attached blanket which depicts the left flap and right pocket wherein the fitted sheet portion (10) is made of thin fabric. The rough hook fastener area (15) is under the left flap and wraps over and on to the right pocket to tighten the blanket over the infant. The left flap (20) is made of a thick fabric that may contain elastane material. The soft loop fastener area (30) extends out past the left flap to allow parents to adjust tightness based on the infant's size. The right pocket (25) is also made of a thick fabric that may contain elastane material.

Figure 6:
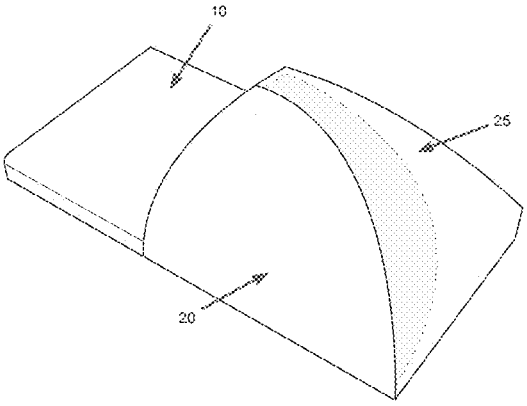
FIG. 6 depicts a perspective view of the infant fitted sheet with attached blanket which depicts the left flap and right pocket.

FIG. 6 depicts a perspective view of the infant fitted sheet with attached blanket which depicts the left flap and right pocket.

Figure 7:
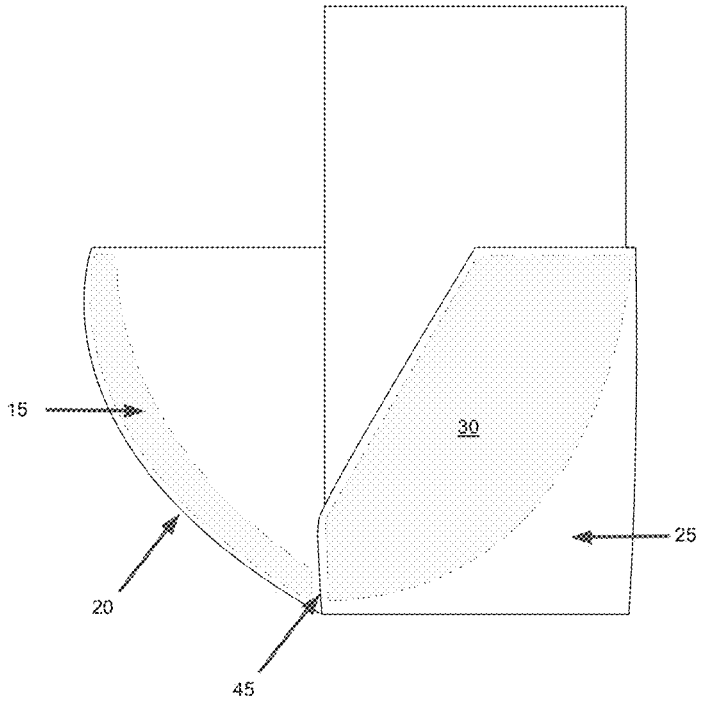
FIG. 7 depicts a top view of the infant fitted sheet with attached blanket which depicts the left flap open.

FIG. 7 depicts a top view of the infant fitted sheet with attached blanket which depicts the left flap open wherein the rough hook fastener area (15) is sewn under the left flap. The right pocket is sewn on the bottom left side (45) as depicted in FIG. 7. The soft loop fastener area (30) is sewn on top of the right pocket.

The invention claimed is:

1. A fitted bed sheet with attached blanket comprising:

a. a fitted bed sheet having an elastic band which is adapted to overlie the top surface and sides of a mattress;

b. an attached blanket secured to said fitted bed sheet, said attached blanket comprising a left flap and a right pocket;

the right pocket having a top left side, a bottom left side, a top right side, and a bottom right side, wherein the bottom left side of the right pocket is attached to the fitted bed sheet and the top left side of the right pocket is not attached to the fitted bed sheet;

the left flap having a top left side, a bottom left side, a top right side, and a bottom right side, wherein the top left side and bottom left side of the left flap is attached to the fitted bed sheet and the top right side and bottom right side of the left flap is not attached to the fitted bed sheet; and c. a hook and loop fastening element adapted to removably join said left flap to said right pocket.

2. The fitted bed sheet with attached blanket in accordance with claim 1, wherein said attached blanket is sewn to said fitted sheet.

3. The fitted bed sheet with attached blanket in accordance with claim 2, wherein said attached blanket has a left side, a right side, and a bottom side, and wherein each of said left side, right side, and bottom side is sewn to the corresponding edges of said fitted bed sheet.

4. The fitted bed sheet with attached blanket in accordance with claim 3, wherein said right pocket is adapted to place and hold an infant therein.

5. The fitted bed sheet with attached blanket in accordance with claim 4, wherein said left flap is adapted to removably join to said right pocket to wrap about an infant and securely maintain the infant within said right pocket.

6. The fitted bed sheet with attached blanket in accordance with claim 4, wherein one component of said hook and loop fastening element is affixed to the underside of said left flap and the complementing component of said hook and loop fastening element is affixed to the to the top surface of said right pocket.

7. The fitted bed sheet with attached blanket in accordance with claim 6, wherein said left flap is removably joined to said right pocket to tighten securely and maintain an infant within said right pocket.

8. The fitted bed sheet with attached blanket in accordance with claim 6, wherein the hook fastening component is affixed to the underside of said left flap and the loop component is affixed to the top surface of said right pocket.

9. The fitted bed sheet with attached blanket in accordance with claim 8, wherein said left flap is removably joined to said right pocket to tighten securely and maintain an infant within said right pocket.

10. The fitted bed sheet with attached blanket in accordance with claim 8, wherein said attached blanket is composed of an elastane-containing material.

11. The fitted bed sheet with attached blanket in accordance with claim 6, wherein said attached blanket is composed of an elastane-containing material.

* * * * *